US007984724B1

(12) United States Patent
Eberle

(10) Patent No.: US 7,984,724 B1
(45) Date of Patent: Jul. 26, 2011

(54) ROLLING WALKING SUPPORT WITH A UTILITY BAG HAVING INTERCHANGEABLE FRONT PANELS PROVIDING ALERT INDICIA

(76) Inventor: Eric Eberle, Los Gatos, CA (US)

( * ) Notice: Subject to any disclaimer, the term of this patent is extended or adjusted under 35 U.S.C. 154(b) by 41 days.

(21) Appl. No.: 12/387,592

(22) Filed: May 4, 2009

(51) Int. Cl.
*A61H 3/04* (2006.01)

(52) U.S. Cl. ..... 135/67; 135/66; 224/407; 40/606

(58) Field of Classification Search ..... 135/66–67; 224/407, 222; 383/38–40, 106, 111; 280/33.992; 40/606
See application file for complete search history.

(56) References Cited

U.S. PATENT DOCUMENTS

| | | | | | |
|---|---|---|---|---|---|
| 2,761,481 | A | * | 9/1956 | Boatwright | 383/22 |
| 3,957,071 | A | * | 5/1976 | Kenner | 135/66 |
| 4,512,504 | A | * | 4/1985 | Owlett | 224/572 |
| 4,676,416 | A | | 6/1987 | Harmon | |
| 4,850,641 | A | | 7/1989 | Walker | |
| 4,859,084 | A | * | 8/1989 | Kaumeyer | 383/39 |
| 4,924,613 | A | * | 5/1990 | Levin | 40/586 |
| 4,974,760 | A | | 12/1990 | Miller | |
| 5,012,963 | A | | 5/1991 | Rosenbaum | |
| 5,048,849 | A | * | 9/1991 | Mathews et al. | 280/47.35 |
| 5,215,379 | A | * | 6/1993 | Pickard et al. | 383/37 |
| D352,260 | S | | 11/1994 | Adamo | |
| 5,511,710 | A | | 4/1996 | Woods et al. | |
| 5,513,789 | A | | 5/1996 | Woods et al. | |
| 5,803,331 | A | * | 9/1998 | Thorne et al. | 224/627 |
| 6,006,462 | A | * | 12/1999 | Lackomar | 40/593 |
| 6,174,082 | B1 | * | 1/2001 | Pelky et al. | 383/22 |
| D477,256 | S | * | 7/2003 | Mills | D12/133 |
| 6,634,531 | B2 | | 10/2003 | Conte | |
| 6,651,683 | B1 | | 11/2003 | Hooks et al. | |
| 6,751,805 | B1 | * | 6/2004 | Austion | 2/94 |
| 6,942,130 | B1 | | 9/2005 | Duva | |
| 6,966,470 | B1 | | 11/2005 | Charlton | |
| 2004/0188299 | A1 | * | 9/2004 | Vaira et al. | 206/424 |
| 2005/0121481 | A1 | | 6/2005 | Chiu | |
| 2007/0278271 | A1 | | 12/2007 | Koren | |
| 2008/0230576 | A1 | * | 9/2008 | Arabadjis | 224/42.2 |

* cited by examiner

*Primary Examiner* — Winnie Yip
(74) *Attorney, Agent, or Firm* — Gene Scott; Patent Law & Venture Group

(57) ABSTRACT

A walker is fitted with a utility bag having pockets on both a front side and a rear side of the bag. Panels are removably attached to the front of the bag. Each one of the panels of a set of panels provides utility messages and illustrations to improve the navigation and safety of the walker most importantly, when the user has poor vision or hearing. The panels may also have illustrations related to sports, hobbies, and serious messages. Generally, the panels provide a novel approach to personalizing the walker.

10 Claims, 6 Drawing Sheets

ROLLING WALKING SUPPORT WITH A UTILITY BAG HAVING INTERCHANGEABLE FRONT PANELS PROVIDING ALERT INDICIA

BACKGROUND OF THE INVENTION

1. Field of the Present Disclosure

This disclosure relates generally to walkers used by the elderly during walking, and more particularly to a walker having a utility bag with a selectively replaceable front panel, the front panels having utility messages and indicia functional for improved safety especially for those with poor sight or hearing.

2. Description of Related Art Including Information Disclosed Under 37 CFR 1.97 and 1.98

Adamo, D352260, discloses the ornamental design for a walker apron with pockets.

Koren, US 2007/0278271 discloses a walker bag which is attached to a walker. The walker bag will attach to the walker with an attaching means like a hook and latch means such as Velcro. Zippers, snaps or buttons are not used so that the current invention is easier to use for those who may not have the dexterity to use those items. Different styles of bags will have different placements of Velcro each with very defined positions for the Velcro. These positions are over the top of the bar and along the side bars at the bottom of the bag. In the preferred embodiment there will be 6 pockets—3 on the face of the unit and 3 on the inside of the unit. These pockets will be elasticized so that they can easily enter the pocket without using zippers, buttons or snaps.

Chiu, US 2005/0121481 discloses a basket with the intention it can be attached to a walking aid and can store a large number of items but does not consume a large amount of space when not in use. The basket can be configured to be removably coupled to the walking aid. The basket includes a frame having sides and ends that are scissor hinges. The scissor hinges operate such that the frame sides can be position next to each other in a collapsed state and separated from each other in an expanded state so as to form an internal cavity to carry items. A flexible material is attached to the frame sides and scissor hinges thereby forming side walls and a bottom.

Charlton, U.S. Pat. No. 6,966,470 discloses a carrying bag assembly which is designed to be detachably securable with respect to the structural bar of a disability aiding device such as a walker and includes a carrying bag with an enclosure for holding items therein and a bag handle. The bag handle preferably includes first and second handle straps. A handle retaining means is securable to the handle and can secure the two straps of the handle together by an inner attachment device which extends around the bag handle for securement thereto. Preferably the inner attachment device includes hook and loop fasteners. An outer attachment mechanism is also included positioned extending around the inner attachment means and secured thereto and being capable of defining a bar retaining channel therein for detachable securement with respect to the structural bar member preferably by Velcro means. An optional lower attachment mechanism can be included for securement of the bag to the walker at a lower position there-adjacent.

Duva, U.S. Pat. No. 6,942,130 discloses a carrier device for providing safety by carrying items for a person using a walker. The carrier device includes a strap member being designed for being selectively coupled to the walker. The strap member is designed for being positioned around a user when the strap member is removed from the walker. A receiving assembly is coupled to the strap member whereby the strap member is designed for coupling the receiving assembly to the walker. The receiving assembly is designed for receiving objects to be carried for the user whereby the receiving assembly is for allowing the hands of the user to be used on the walker to enhance the safety of the user using the walker.

Hooks et al., U.S. Pat. No. 6,651,683 discloses a method and apparatus for carrying a reacher on a walker this includes a bag which is shaped and dimensioned to receive the reacher. Straps on the bag allow the bag to be attached to one of the side assemblies of the walker so that the bag is held in a convenient angled back position. The mouth of the bag is biased open so that the reacher may be easily inserted and removed.

Conte, U.S. Pat. No. 6,634,531 discloses a pocket system providing easy attachment to a variety of support surfaces, such as crutches, walkers, backpacks, etc. The system has at least one pocket having an open end to receive articles. At least one pocket securing member is attached to the back of the pocket proximate the open end to affix the pocket to a horizontal portion of the support surface. A stabilizing strap, or straps, is affixed to the back of the pocket proximate the closed end, adding stability by affixing the pocket to a vertical portion of the support surface. Preferably the stabilizing straps extend from opposite sides of the pocket for maximum security. One end of the securing members(s) and strap(s) can be permanently secured to the pocket, with the other end removably affixed through various means known in the art. Alternatively all of the methods of attachment of the pocket securing member(s) and stabilizing strap(s) can be removable.

Woods et al., U.S. Pat. No. 5,513,789 discloses reflective fabrics are used extensively throughout strong, expandable, selectively and resiliently restrained, fabric accessories for removable securement to crutches and walkers, so as to provide expandable carrying volumes for personal use items and shopping items, while at the same time presenting the reflective fabric portions to be readily observed, especially by operators of vehicles. In this Divisional Application, the claims are directed to providing a pocket accessory for walkers.

Woods et al., U.S. Pat. No. 5,511,710 discloses reflective fabrics are used extensively throughout strong, expandable, selectively and resiliently restrained, fabric accessories for removable securement to crutches and walkers, so as to provide expandable carrying volumes for personal use items and shopping items, while at the same time presenting the reflective fabric portions to be readily observed, especially by operators of vehicles. In this Divisional Application, the claims are directed to providing a pocket accessory for crutches.

Rosenbaum, U.S. Pat. No. 5,012,963 discloses a walker support tote bag as adapted to be mounted to a walker support for carrying a variety of articles. The tote bag includes a large inner compartment within the tote bag for receiving a variety of articles and outer peripherally spaced pockets along an outer face of the tote bag for receiving articles, generally of smaller size. The outer peripherally spaced pockets have a different contrasting color than the tote bag to aid a user in positioning articles within the pockets. The tote bag and the outer peripherally spaced pockets are made from flexible material to enable the tote bag to be closed and collapsed for carrying and storage purposes. For mounting the tote bag to the walker support, strap elements are attached to the tote bag and are configured, arranged and dimensioned relative to the tote bag to cause the large inner compartment thereof to be continuously maintained in an open position for receipt of a variety of articles therein, as well as to enable the outer peripherally spaced pocket to also receive articles.

Miller, U.S. Pat. No. 4,974,760 discloses an article carrier attachable to a front brace of a walker and composed of a flexible material whereby the article carrier is foldable with the walker as the walker is collapsed for storage or transport. The article carrier has front and rear panels which extend generally over the width of the walker and has side panels the width of each of which is less than about 5 inches to reduce instability effects of the carrier which might otherwise result if the carrier were positioned too far outside of the space between the walker legs while at the same time reducing the space taken up by the carrier between the walker legs so that more comfortable use of the walker may be afforded the user. Tabs are provided on the side panels to attach to the respective front legs of the walker to prevent "bunching" of the article carrier toward the center. Thus, increased mobility may be provided to the user for a more independent and higher quality life.

Walker, U.S. Pat. No. 4,850,641 discloses a combination carrying pouch and seat for walkers. The inventive device includes a substantially rectangular piece of material having one end which may be securely fastened to front portions of the walker and having another end which may be releasably attached to either rear portions of the walker or front portions thereof. When the another end of the walker is attached to rear portions of the walker, the material is in an open configuration and may be used as a seat. When the another end is attached to front portions of the walker, the material is in a folded configuration rendering it usable as a carrying pouch.

Hannon, U.S. Pat. No. 4,676,416 discloses an invalid walker and carrier therefor, wherein the carrier is constructed so as to be readily collapsible and portable, and to provide for greater utility and purpose; and which is constructed so that it can be detachably connected to any of the more popular walkers. The carrier includes a bottom panel having a connected circumscribing side wall, both of which are formed from flexible sheet fabric type materials, wherein the bottom panel is formed with a co-extensive pocket for detachably receiving a rigid member for stabilizing the carrier. The carrier is also provided with straps to form hanging loops for suspending the carrier from the upper frame portion of the walker. The hanging loops or straps are arranged so that the carrier can be readily attached to any of the popular walker constructions so that the carrier is disposed within the area defined by the leg members of the walker.

The related art described above discloses INSERT. However, the prior art fails to disclose INSERT. The present disclosure distinguishes over the prior art providing heretofore unknown advantages as described in the following summary.

BRIEF SUMMARY OF THE INVENTION

This disclosure teaches certain benefits in construction and use which give rise to the objectives described below.

A walker is fitted with a utility bag having pockets on both a front side and a rear side of the bag. The pockets are sized and functional for carrying items that the user is not able to carry on his or her person. A set of panels may be used with the walker, each of the panels being easily attached to the front of the utility bag or removed when desired. Each one of the panels provides a utility message and illustrations to improve the navigation and safety of the walker and most importantly, when the user has poor vision or hearing. The panels may also have illustrations related to sports, hobbies, and serious messages. A panel may also have pockets for displaying favorite photographs. The panels are a novel approach to personalizing a walker.

A primary objective inherent in the above described apparatus and method of use is to provide advantages not taught by the prior art.

Another objective is to provide a walker with a vertically oriented highly visible message panel visible to those toward which the walker is approaching so as to indicate that special care and concern should be taken due to physical limitations of the person using the walker.

A further objective is to provide such a walker with an interchangeable variety of such message panels that may attract attention, send a message, amuse, or interest others.

A still further objective is to provide such a walker with a utility bag that is attached to a horizontal brace in such a manner that the brace acts as a backup support to the bag, and also with a mounting that prevents the bag from swinging when the walker is in motion.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

Illustrated in the accompanying drawing(s) is at least one of the best mode embodiments of the present invention In such drawing(s):

DETAILED DESCRIPTION OF THE INVENTION

The above described drawing figures illustrate the described apparatus and its method of use in at least one of its preferred, best mode embodiment, which is further defined in detail in the following description. Those having ordinary skill in the art may be able to make alterations and modifications to what is described herein without departing from its spirit and scope. Therefore, it should be understood that what is illustrated is set forth only for the purposes of example and should not be taken as a limitation on the scope of the present apparatus and its method of use.

Figure 1:
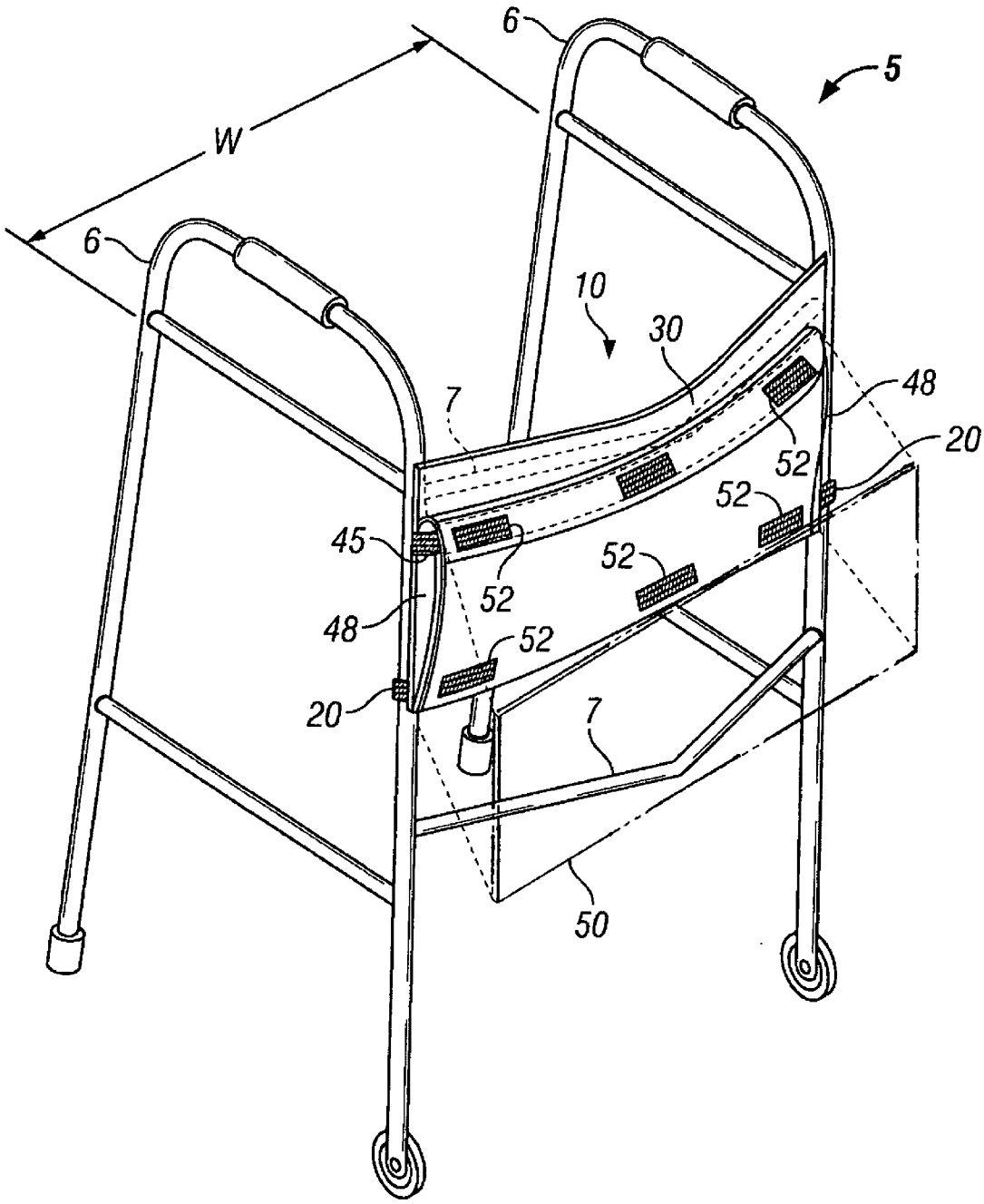
FIG. 1 is a perspective view of the presently described apparatus shown with a display panel in phantom line.
Figure 4:
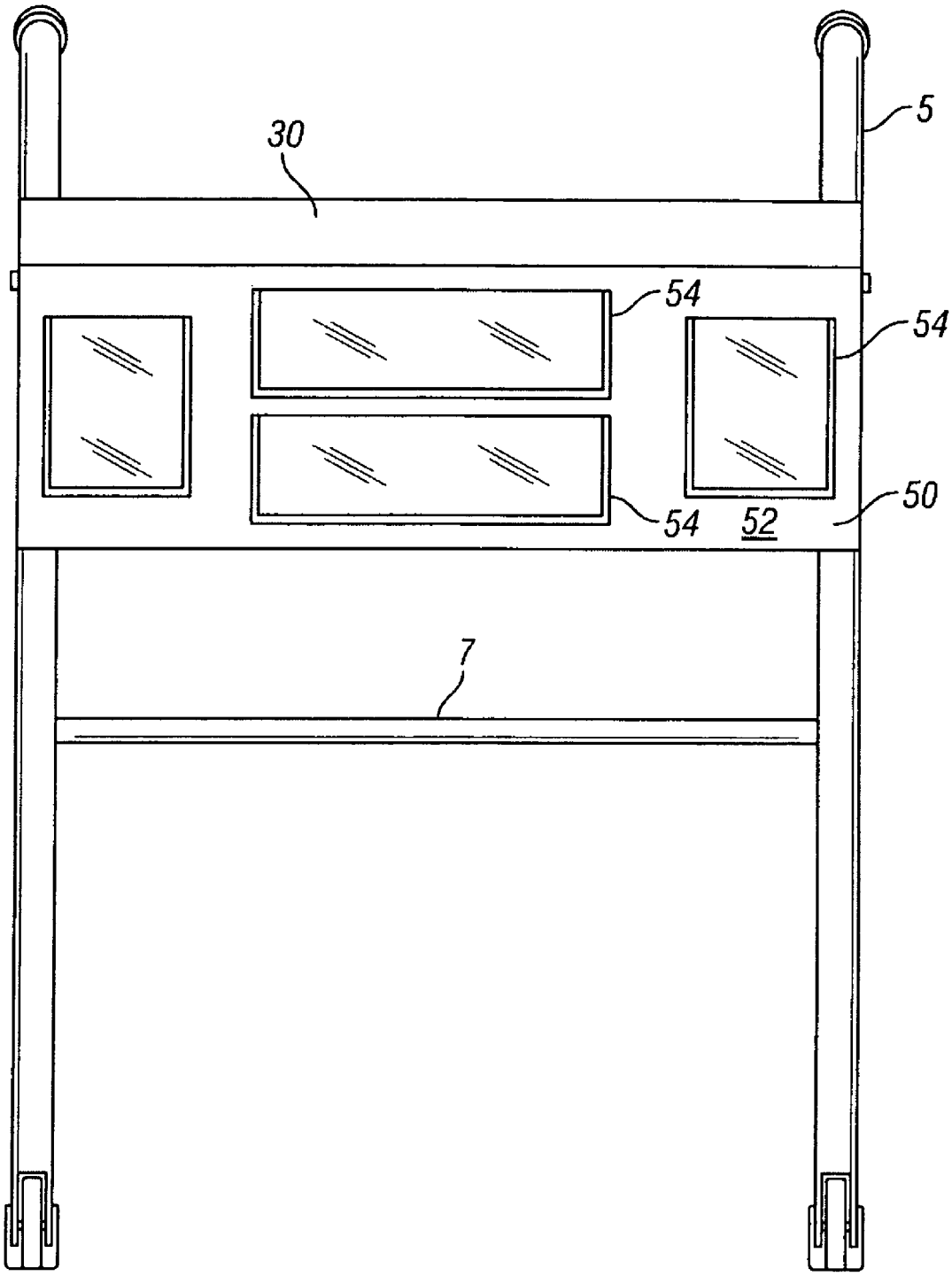
FIG. 4 is a front elevational view thereof shown with a display panel attached.
Figure 5:
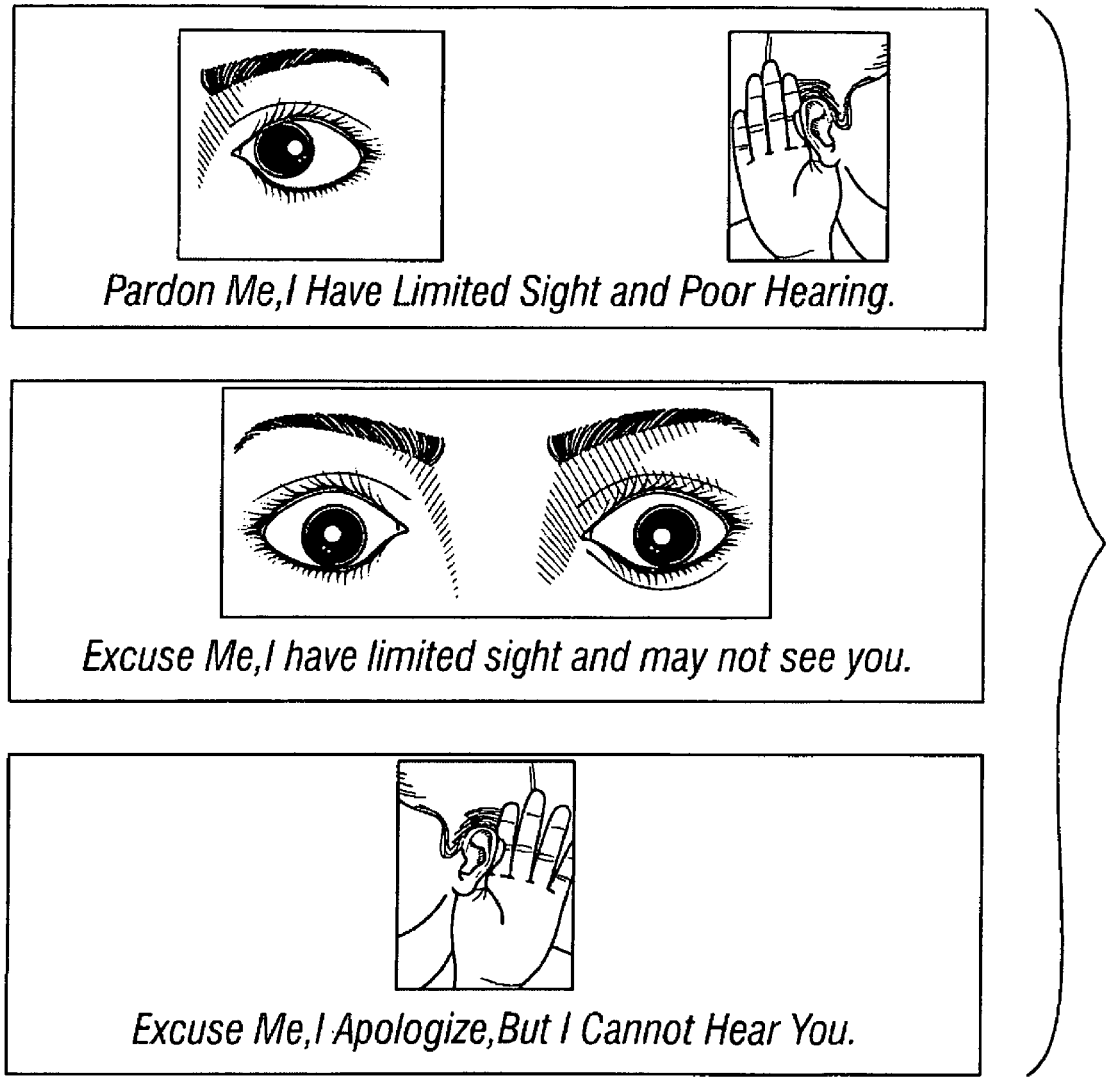
FIG. 5 is an elevational view of several display panels of the invention illustrating utility indicia providing safe operation of the apparatus and its user.

Described now in detail is a rolling walking support having a utility bag that accepts interchangeable front panels providing alert indicia. The rolling walker is commonly referred to as simply a "walker" and is primarily a frame 5 which may have wheels or not. The present invention is a combination of such a walker frame 5 and a walker bag 10 as shown in FIG. 1. The frame 5 has a pair of vertically oriented side frames 6 spaced apart by a horizontal width dimension "W" and joined together by horizontal struts 7. The walker bag 10 is secured to frame 5 as shown in FIG. 1 and FIG. 4. In FIG. 4 we see that three hoop and loop material straps 20, which are permanently attached to bag 10, and positioned well below its top edge 12, are wrapped around an upper one of the horizontal struts 7. Therefore, upper strut 7 acts as a backup support to bag 10. Two further straps 20 are permanently attached at low positions on bag 10, adjacent to, and wrapped around forward legs of side frames 6. The straps 20 may be released from frame 5 in order to remove bag 10. In FIG. 5 the rear leg on the right side, which is visible in this figure, is broken away so as to better show how strap 20 encircles the forward leg. See also, FIG. 1.

Figure 2:
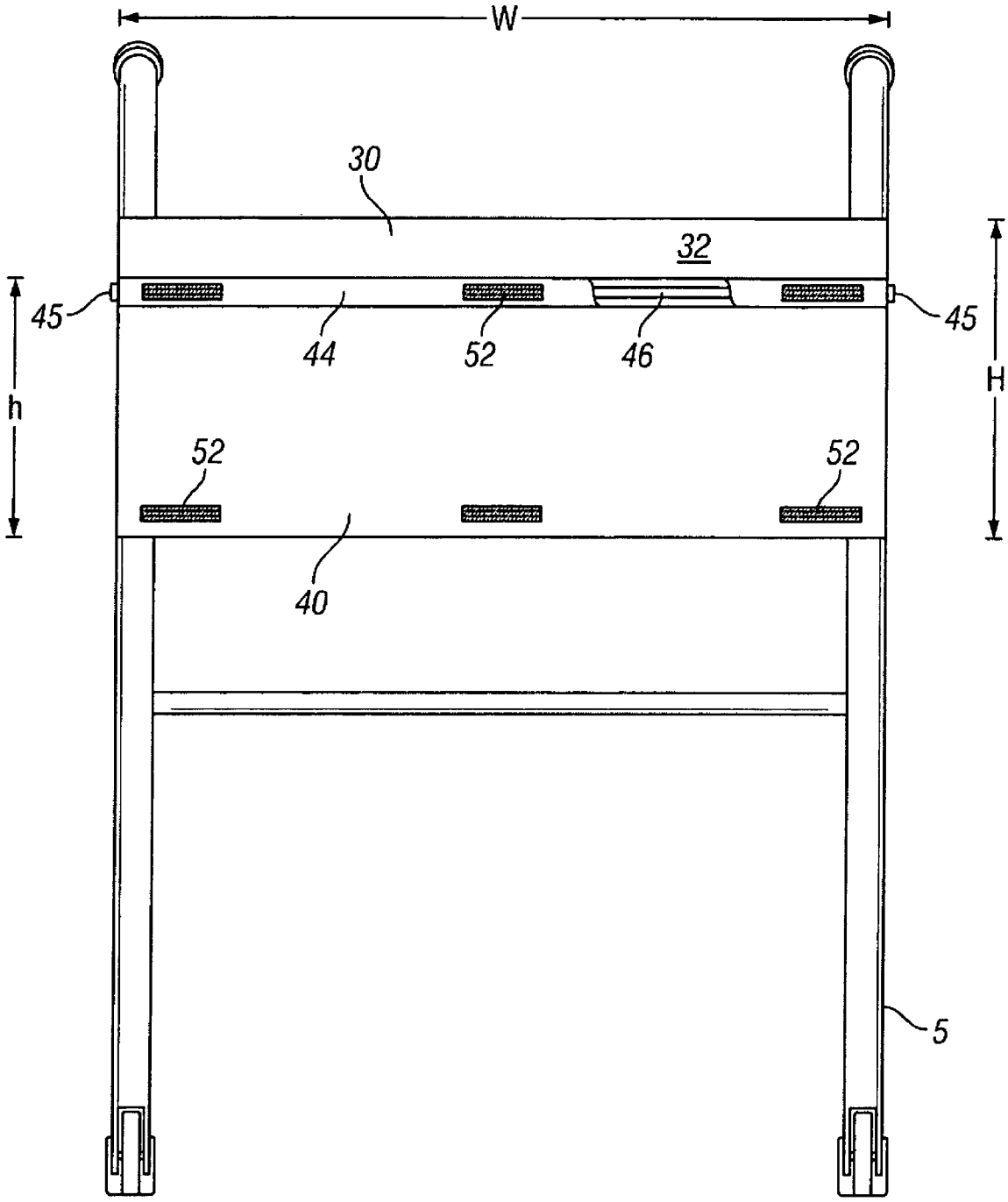
FIG. 2 is a front elevational view thereof shown without a display panel.

Walker bag 10 has a main panel 30 of a fabric material which is somewhat flexible yet stiff enough to be self supporting, and is configured with width dimension W and height dimension "H" as defined in FIG. 2. Main panel 30 has a front surface 32 facing in the direction in which the walker moves when in use, and a rear surface 34 (FIG. 4) in opposition to the front surface 32 so that it faces the user. The straps 20 are attached to the rear surface 34 of the main panel 30. Main panel 30 is positioned so that upper strut 7 is directly it and acts to stiffen the upper portion of main panel 30 so that it is inhibited from flexing rearwardly. This is important when mounting and supporting display panels 50 as will be described below. A front pocket panel 40 of width dimension W and a height dimension "h" (FIG. 2) is secured along its bottom edge to front surface 32 thereby defining a front pocket as shown in FIG. 1. Because there is no strut 7 behind the lower portion of main panel 30, both forward and rearward portions of the front pocket are free to flex away from each other providing an improved comfort and accessibility to ones hand when searching within, and grasping, items in the front pocket.

As shown, front pocket panel 40 provides a hem 44 extending along its top edge, with an elastic band 46 extensive within the hem 44, and terminal ends 45 of band 46 extend outwardly from hem 44 at both lateral ends and are secured to the rear surface 34 of the main panel 30. Securement of band 46 to the rear surface 34 is advantageous in that as band 46 is folded around the side edges of main panel 30, it is more strongly secured and held in place, not only by the means used to secure it, usually a sewn connection, but also by friction. This has been shown to provide a significant advantage in wear and durability of the front pocket, which, extensive over the full width W, receives significant activity, that is, pulled open frequently. Vertical left side and right side fabric folds 48 join front pocket panel 40 and the front surface 32 of the main panel 30 thereby leaving only the top edge of hem 44 open. Fabric folds 48 allow the front pocket to expand outwardly in order to hold a greater bulk of items then would otherwise be the case. Hem 44 is able to be pulled forward to open the front pocket, as elastic band 46 stretches, and the side fabric folds 48 extend forwardly, thus enabling the front pocket to expand its interior volume as desired.

Figure 3:
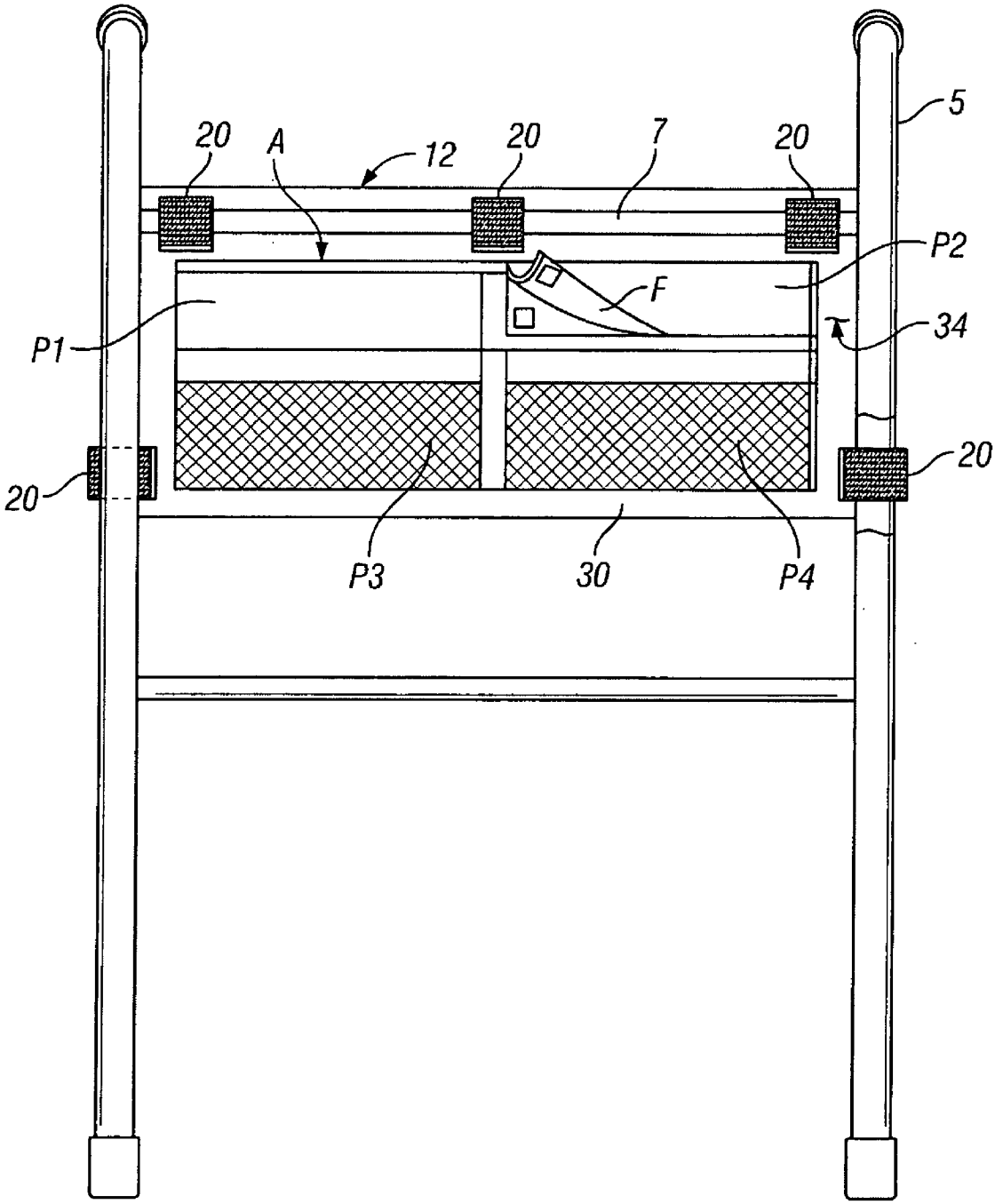
FIG. 3 is a rear elevational view thereof.

As shown in FIG. 3 an arrangement of back pockets are placed for utility in the usage of walker bag 10. In the preferred embodiment, four pockets are provided, "P1", "P2", "P3" and "P4", two pockets, P1 and P2, mounted directly to surface 34; and two pockets P3 and P4 mounted onto the outside of pockets P1 and P2 respectively. Pocket P1 is entered through the top according to arrow "A" and pocket P2 is also entered through the top, but has a flap "F", shown partially pulled up, with hook and loop closure, as shown, for improved security. Pockets P3 and P4 are formed between the exterior surfaces of pockets P1 and P2 and a net material, so that one is able to see the contents within these two pockets (P3 and P4).

Figure 6:
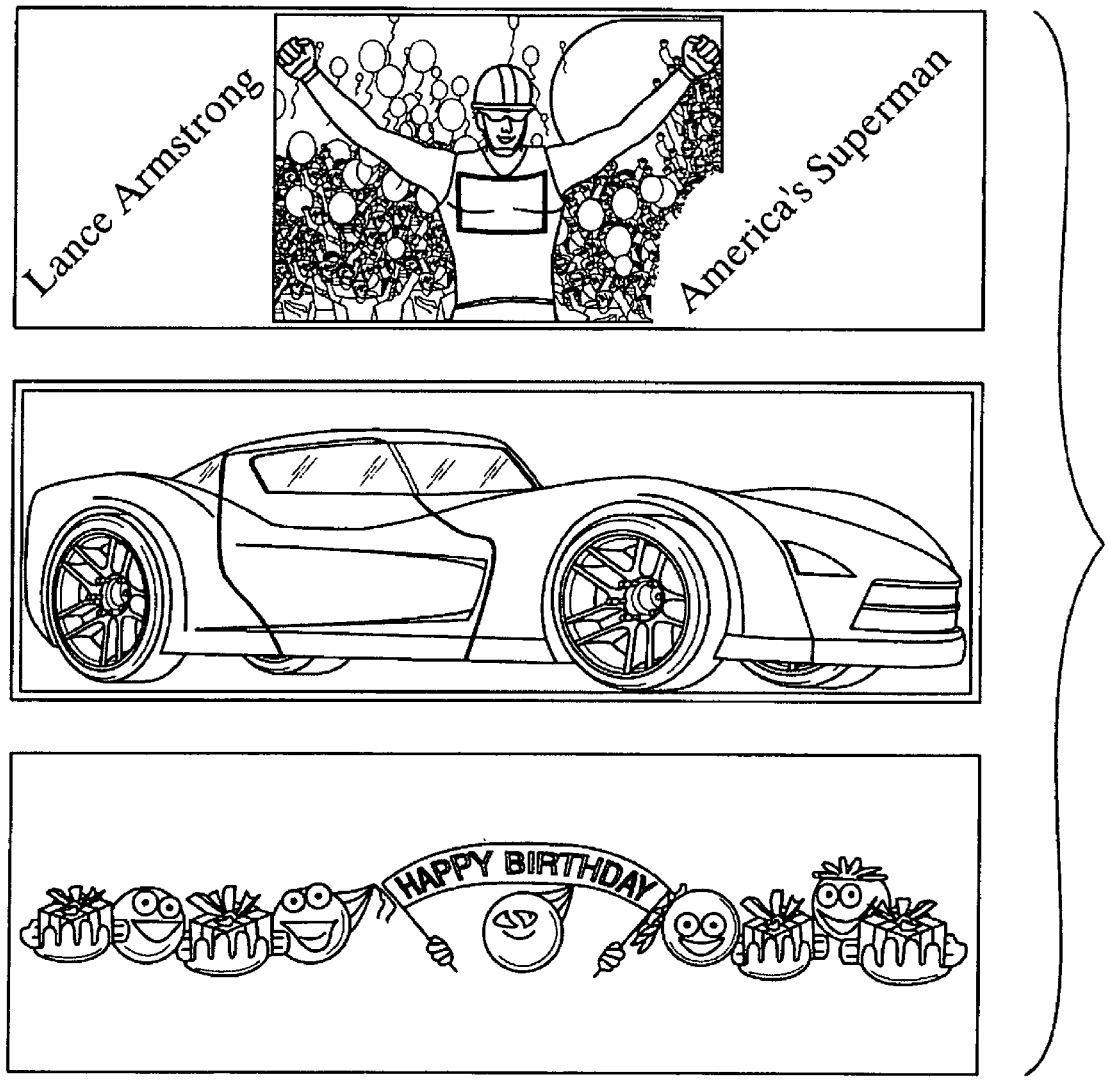
FIG. 6 is an elevational view of several display panels of the invention illustrating further utility indicia.

A display panel 50 (FIGS. 4-6) of width dimension W and height dimension h, or greater, is removably fastenable to the front pocket panel 40 by an attachment means 52, such as hook and loop material, as shown in FIGS. 1 and 2. Therefore, the display panel 50 is easily attached and detached as desired. On the frontal surface 52 of display panel 50 there is provided, in a first embodiment shown in FIG. 4, a means for displaying indicia as flat items such as photographs. This displaying means includes flat pockets 54 with transparent windows. Such a display is considered useful for attracting the attention of others which may be helpful in assuring empathy from others and improved awareness of the walker and its user. In FIGS. 5 and 6 alternative display panels 50 are shown. In these panels the frontal surface 52 provides a permanent indicia. In FIG. 5 we see panels 50 with indicia related to the physical limitations of the walker's user. In the top illustration, the statement, "Pardon me, I have limited sight and poor hearing" along with the eye and ear pictures clearly announces and strongly communicates to the public that the walker is being used by a handicapped person who may have difficulty seeing or hearing those that may get in the path of the walker. We all have seen walkers with bells or horns on them. It is clear that the present invention is an extension of this same idea but has the advantage of communicating the physical difficulties of the walker's user to the unwary. In FIG. 6 are shown other possible indicia. These indicia do not try to appeal in a sympathetic and informative way to gain attention to the walker, but rather present subjects of general interest that will easily gain attention at a glance. The panels 50 provide utility benefit by alerting others, as the walker approaches, to the weaknesses or merely to the presence of the walker and its user.

The sides and bottom edges of the main panel 30, the front pocket panel 40 and the display panel 50 are all mutually aligned. The alignment of the bottom and side edges of the main panel 30 and the front pocket panel 40 enable these two fabric panels to be cut and sewn together thereby saving a certain amount of added alignment effort and double sewing. The top edges of the front pocket panel 40 and the display panel 50 are mutually aligned so that the display panel 50 does not obscure or hinder access to the front pocket.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. A mobile apparatus for supporting a person during standing and walking, the apparatus having a width normal to an intended direction of travel of the apparatus, the width approximating the width of the person, the apparatus further for informing others of a physical limitation of the person in order to improve safety to both the person and to the others, the apparatus comprising:

a frame constructed with said width, the frame further having a pair of hand grips for supporting and balancing the person, the frame enabled for being pushed along a supporting surface by the person as the person walks in the intended direction of travel;

a bag secured to the frame, the bag spanning the width of the apparatus and having a bag surface oriented normal to the intended direction of travel, the bag surface having portions of a first releasable surface fastening means attached thereto, the portions arranged in two horizontal rows, wherein, in each of the horizontal rows, one portion of the fastening means is medially positioned on the bag surface, and two further of the fastening means are positioned in spaced apart lateral positions relative to the one portion;

a display panel having on a reverse surface thereof portions of a second releasable surface fastening means positioned for engaging the portions of the first releasable surface fastening means, and on an obverse surface an indicia related to a physical limitation of the person;

whereby, the person may move along the intended direction supported by the apparatus while alerting others of the physical limitation of the person.

2. The mobile apparatus of claim 1 wherein a portion of the first releasable surface fastening means is adjacent to a strut of the frame.

3. The mobile apparatus of claim 1 wherein the indicia is a message alerting viewers to a hearing limitation of the person.

4. The mobile apparatus of claim 1 wherein the indicia is a message alerting viewers to a visual limitation of the person.

5. The mobile apparatus of claim 1 wherein the display panel includes an interchangeable plurality thereof.

6. A mobile apparatus for supporting a person during standing and walking, the apparatus having a width normal to an intended direction of travel of the apparatus, the width approximating the width of the person, the apparatus further for informing others of a physical limitation of the person in order to improve safety to both the person and to the others, the apparatus comprising:

a frame constructed with said width, the frame further having a pair of hand grips for supporting and balancing the person, the frame enabled for being pushed along a supporting surface by the person as the person walks in the intended direction of travel;

a bag secured to the frame, the bag spanning the width of the apparatus and having a bag surface oriented normal to the intended direction of travel, the bag surface covered with a first releasable surface fastening means;

a display panel having on a reverse surface thereof portions of a second releasable surface fastening means positioned in two horizontal rows, wherein, in each of the horizontal rows, one portion of the second fastening means is medially positioned on the reverse surface, and two further of the second fastening means are positioned in spaced apart lateral positions relative to the one portion, the first and second fastening means mutually engaged for removably securing the display panel to the bag, and on an obverse surface of the display panel an indicia related to a physical limitation of the person, the obverse surface positioned normal to the intended direction of travel of the apparatus with the indicia facing in the intended direction of travel;

whereby, the person may move along the intended direction of travel supported by the apparatus while alerting others of the physical limitation of the person.

7. The mobile apparatus of claim 6 wherein a portion of the first releasable surface fastening means is adjacent to a strut of the frame.

8. The mobile apparatus of claim 6 wherein the indicia is a message alerting viewers to a hearing limitation of the person.

9. The mobile apparatus of claim 6 wherein the indicia is a message alerting viewers to a visual limitation of the person.

10. The mobile apparatus of claim 6 wherein the display panel includes an interchangeable plurality thereof.

* * * * *